United States Patent [19]

Stout

[11] 4,423,773

[45] Jan. 3, 1984

[54] SINGLE ACTING SUBTERRANEAN WELL VALVE ASSEMBLY WITH CONDUIT FLUID STRIPPING MEANS

[75] Inventor: Gregg W. Stout, Montgomery, Tex.

[73] Assignee: Baker International Corporation, Orange, Calif.

[21] Appl. No.: 285,220

[22] Filed: Jul. 17, 1981

[51] Int. Cl.[3] ..... E21B 34/12; E21B 43/04

[52] U.S. Cl. ..... 166/51; 166/317; 166/326; 166/373

[58] Field of Search ..... 166/317, 316, 325, 326, 166/205, 51, 133, 278, 373, 334

[56] References Cited

U.S. PATENT DOCUMENTS

| | | | |
|---|---|---|---|
| 2,101,640 | 12/1937 | Chonette et al. | 166/133 X |
| 2,187,487 | 1/1940 | Burt | 166/133 X |
| 2,651,369 | 9/1953 | Abendroth et al. | 166/278 |
| 2,652,117 | 9/1953 | Arendt et al. | 166/278 |
| 3,062,284 | 11/1962 | Brown | 166/278 |
| 3,421,586 | 1/1969 | Solum | 166/205 X |
| 3,957,114 | 5/1976 | Streich | 166/325 X |
| 4,122,898 | 10/1978 | Nelson | 166/325 |

*Primary Examiner*—Stephen J. Novosad

*Attorney, Agent, or Firm*—Norvell & Associates

[57] ABSTRACT

A formation protection valve is normally held in an open position relative to an annular elastomeric valve seat by an inserted wash pipe during performance of a gravel packing operation in a subterranean well. Upon removal of the wash pipe, a valve head swings downwardly to a sealing position on an annular elastomeric valve seat. A valve seat support structure is mounted below the annular valve seat to provide support of the inner periphery of the annular valve seat against downward fluid pressure forces exerted on the valve head. The elastomeric valve seat is shearable by a subsequently inserted tubing string, which also effects the displacement of the valve seat support structure to a radially outwardly disposed position wherein it no longer interferes with the passage of the tubing string therethrough.

13 Claims, 8 Drawing Figures

SINGLE ACTING SUBTERRANEAN WELL VALVE ASSEMBLY WITH CONDUIT FLUID STRIPPING MEANS

BACKGROUND OF THE INVENTION

1. Field of the Invention

The invention relates to a formation protection valve that may be inserted in the casing of a subterranean well at a position above a production formation and operated to a closed position upon the withdrawal of the mandrel and wash tube commonly employed for effecting the gravel packing of the screen and production formation, to protect the underlying formation from fluids remaining in the well upon withdrawal of the gravel packing equipment.

2. Description of the Prior Art

A number of operations are performed in the completion and maintenance of subterranean wells that require the introduction of fluids into the well and the production formation for specific purposes. For example, subsequent to gravel packing, completion fluids are introduced to the well to displace the fluid used during the gravel packing procedure. When the gravel packing and completion fluid introduction operations are completed, it is, of course, necessary to remove the mandrel and associated wash tube of the gravel packing apparatus and, in particular, the tubular work string carrying such apparatus, and substantial quantities of completion fluid are normally contained in the removed apparatus. It is, therefore, desirable to prevent the loss of such costly fluid by flow into the formation upon the removal of the tubular work string and the associated gravel packing apparatus from the well.

There is, therefore, a distinct need for a valve which may be conveniently inserted into the well casing in an open position above a production formation so that a wash tube of a gravel packing apparatus may be readily inserted through the open valve to extend to a position adjacent the production formation. Such valve should be automatically closeable by the withdrawal of the wash string from the well and it is further desirable that the external surface of the wash pipe be wiped of any adhering fluid during such withdrawal movement. Of equal importance is the need for the reliable reopening of the valve upon the insertion of the production tubing or another work string into the well, and particularly the removal of the valve elements from the path of the production string, permitting the bottom of such string to be moved to a position adjacent the production formation.

SUMMARY OF THE INVENTION

The invention provides a shiftable valve mounted in a valve housing which, in turn, is appropriately secured within the casing of the subterranean well at a position above a production formation. The valve comprises a valve head mounted on a horizontally pivoted arm of a torsion spring and the valve head is normally held in an inoperative position with respect to an annular elastomeric valve seat by a wash pipe inserted in the housing prior to the initial run-in of the equipment into the well. The torsion forces in the spring urges the valve head supporting arm downwardly to a closed position in sealing engagement with an annular elastomeric seal element which also snugly engages the periphery of the inserted wash pipe. The outer periphery of the annular valve is sealingly engaged with the housing bore and retained by a support sleeve shouldered in the housing. Upon removal of the wash pipe, the lower exterior surface portions of the wash pipe are stripped of any adhering fluid by the frictional engagement therewith of the annular elastomeric seal element. When the end of the wash pipe clears the valve head, the valve head swings downwardly under the bias of its torsion spring support to effect a sealing engagement with the annular elastomeric seal.

To effect the convenient opening of the closed formation protection valve, the valve head is secured to the free end of the torsion spring support arm by a shearable bolt. Thus, a substantial increase in internal pressure in the valve housing will have the effect of shearing such bolt and forcing the valve head downwardly through the annular elastomeric seal element. More commonly, the bottom end of a subsequently inserted production string, or another work string, engages the support arm and exerts a downward force upon such arm sufficient to force the valve head through the annular elastomeric seal element. During such forceable movement, the retaining bolt is sheared through sliding contact with the end face of the inserted tubing string.

In order to ensure that the formation protection valve would not inadvertently open under a modest increase in internal fluid pressure in the valve housing, a seat support sleeve is provided having its upper portion formed as radially outwardly biased collet arms, the upper ends of which are compressed inwardly by a retaining sleeve to form a vertical support for the inner periphery of the annular elastomeric valve seat. This vertical support prevents any modest fluid pressure existing above the valve head from forcing the valve head through the opening in the annular elastomeric valve seat. However, when any subsequently inserted production string contacts the valve head, it can impose sufficient downward force on the collet support sleeve to effect the shearing of shear pins which hold the collet support sleeve in the valve supporting position in the valve housing. The collet support sleeve is thus moved downwardly, permitting the valve head to be forced downwardly through the annular elastomeric seat, producing radial tears in the inner periphery of the elastomeric seat. After a limited downward movement of the collet support sleeve, the head portions of the collet arms of such sleeve ride off the retaining sleeve and spring outwardly into an appropriate annular recess provided in the housing wall, thus permitting unimpeded passage of the subsequently inserted production string downwardly through the entire valve housing.

BRIEF DESCRIPTION OF THE DRAWINGS

FIGS. 1B and 1C being respectively vertical continuations of FIGS. 1A and 1B.

DESCRIPTION OF THE PREFERRED EMBODIMENTS

Figure 1A:
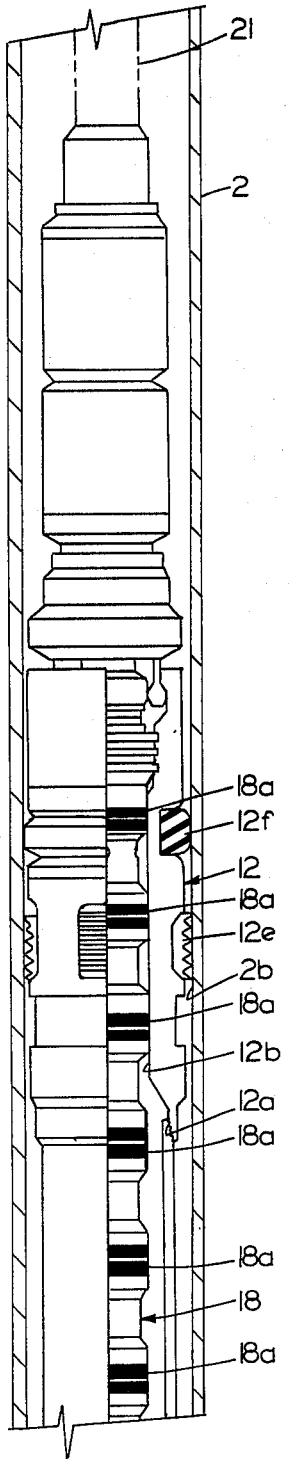
FIGS. 1A, 1B, and 1C collectively represent a vertical sectional view of a gravel packing apparatus inserted in a well and incorporating a formation protection valve embodying this invention.
Figure 1B:
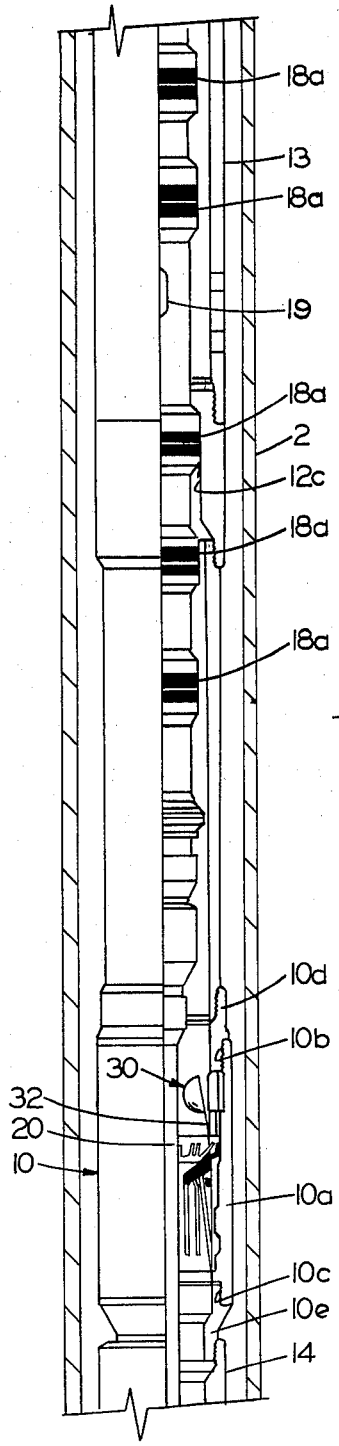
Figure 1C:
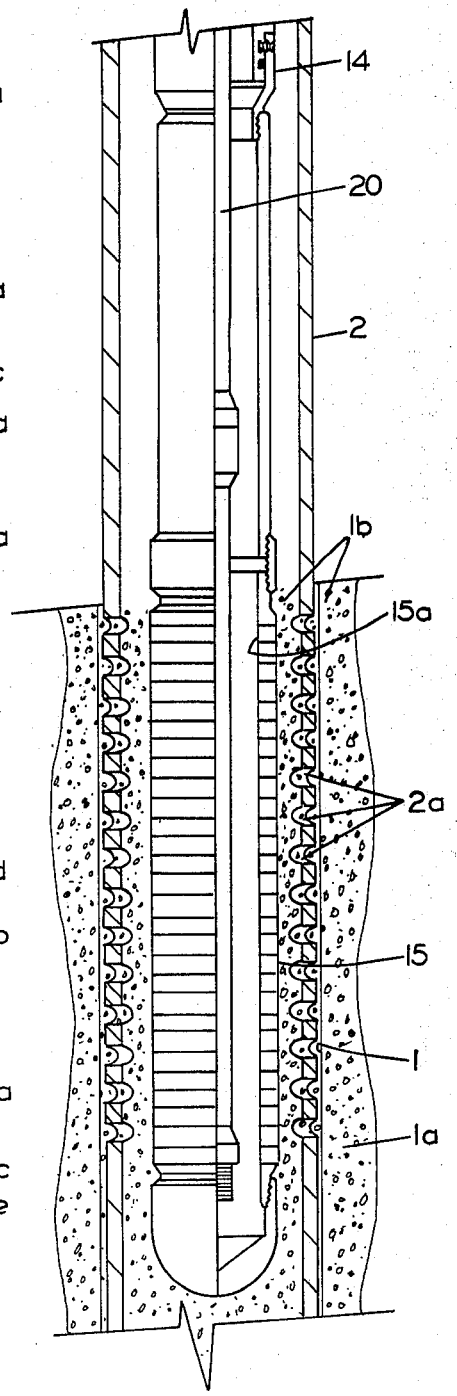

Referring to FIG. 1, the numeral 1 designates a well bore having a production formation 1*a*. A casing 2 is inserted into well bore 1 and provided with perforations 2*a* in conventional fashion. Within the casing 2, a formation protection valve housing 10 is mounted by any conventional form of packer 12 which is expanded to achieve a rigid sealed engagement with the internal bore 2*b* of the casing 2.

Valve housing 10 may comprise one of a plurality of threadably interconnected tubular elements, such as a conventional perforated extension sleeve 13, a conventional shear out safety joint 14, and a conventional screen assemblage 15, all of which are suspended from the internal threads 12*a* provided in the packer 12.

Valve housing 10 is preferably located just above the shear out safety joint 14. Valve housing 10 includes a central elongated sleeve portion 10*a* having internal threads 10*b* and 10*c* respectively connecting to an upper connector sub 10*d* and a lower connector sub 10*e*.

As shown in FIG. 1, a conventional gravel packing mandrel 18, including a crossover portion 19 and a wash pipe 20, is inserted through the bore defined by packer 12 and the tubular elements depending therefrom, including the protector valve housing 10. The wash pipe 20 extends to a position within the bore 15*a* of the screen 15.

The gravel packing apparatus thus assembled may comprise any one of several well known types, such for example, the gravel packing assemblage described and illustrated on Pages 6 and 7 of the Baker Sand Control Catalog, 1980–1981, published by Baker International Corporation. As is well known to those skilled in the art, such gravel packing apparatus is suspended from a tubular work string 21 and includes expansible slips 12*e* and an expansible seal 12*f* for secure sealing engagement with the bore 2*b* of casing 2. Such apparatus further includes serially connected sleeves defining seal bores 12*b* and 12*c* for cooperation with axially spaced sealing elements 18*a* provided on the inserted crossover mandrel 18.

The operation of such gravel packing apparatus is entirely conventional and forms no particular part of this invention. Its function is to provide a packing of gravel 1*b* around the annulus defined between the screen 15 and the casing bore 2*b* and also in the casing perforations 2*a* and the surrounding perforations in the production formation 1*a*. When the tubular work string 21 is elevated out of the well casing, all of the residual completion fluid contained therein would drain into the production formation and would thus not only entail an economic loss of relatively expensive fluid, but additionally, such fluid could very well adversely affect the production efficiency of the well.

To prevent such adverse effects, this invention provides a shiftable formation protection valve 30 which is appropriately mounted on a valve mounting ring 31 (FIG. 2) which is secured by a set screw 31*a* to the interior of the mounting ring 31.

Figure 2:
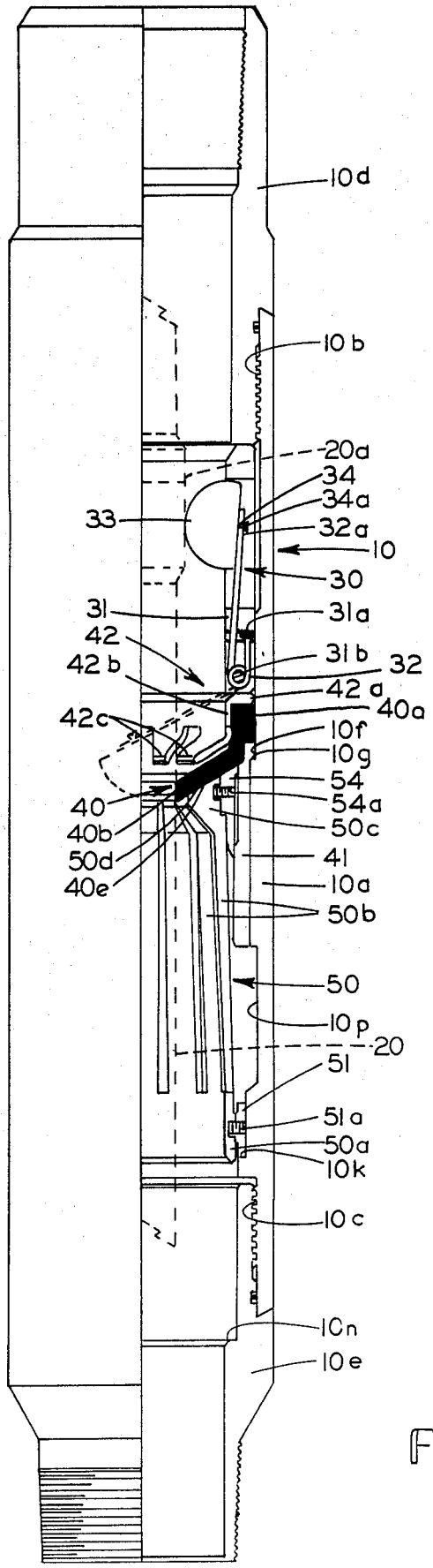
FIG. 2 is an enlarged scale vertical quarter section view of the formation protection valve incorporated in FIGS. 1A, 1B, and 1C, with the valve elements shown in their opened position.

The formation protection valve 30 preferably comprises a flapper valve construction including a torsion spring 32 which is mounted on a suitable horizontal pin 31*b* traversing the wall of the mounting ring 31 and having an elongated arm portion 32*a* which normally tends to occupy a downwardly inclined position, as shown in dotted lines in FIG. 2. A semi-spherical valve element 33 is secured to the underside of the spring arm 32*a* by a shear bolt 34 having a head portion 34*a* which projects above the plane of the spring arm 32*a* for a purpose to be hereinafter described. The wash pipe 20, which is inserted within the valve housing 10 prior to run-in of the gravel packing apparatus into the well, is provided with a radially enlarged portion 20*a*, which may comprise a joint in the pipe sections making up the wash pipe. Enlarged portion 20*a* engages the semi-spherical valve head 33 and holds it in its fully open position, illustrated in FIG. 2, wherein it is biased to swing downwardly by the torsion spring 32 upon removal of the wash pipe 20 from the valve housing 10.

The semi-spherical valve head 33 cooperates in sealing relationship with an annular elastomeric valve seat 40 which is mounted within housing portion 10*a* at a position below the mounting pin 31*b* for the flapper valve assemblage 30. The outer peripheral portion 40*a* of the annular valve seat 40 maintains a sealing engagement with the inner bore 10*f* of the housing sleeve portion 10*a* and is secured against vertical displacement by a sleeve 41. Sleeve 41 has a downwardly facing shoulder 41*a* cooperating with an upwardly facing shoulder 10*g* formed in the interior bore of the housing sleeve portion 10*a*.

An annular metallic valve shearing element 42 is provided having a horizontal flange portion 42*a* mounted between the top surface of the periphery of the annular elastomeric valve seat 40 and the bottom surface of the support ring 31. Annular shearing element 42 is further provided with an integral depending vertical sleeve portion 42*b* which terminates in a plurality of radially inwardly and downwardly projecting finger portions 42*c* which overlie the central portions of the annular elastomeric valve seat 40 for a purpose to be hereinafter described. The finger portions 42*c* do not project inwardly so far as to prevent the sealing engagement of the semi-spherical valve head 33 with the inner extremities of the annular elastomeric valve seat 40.

Figure 3:
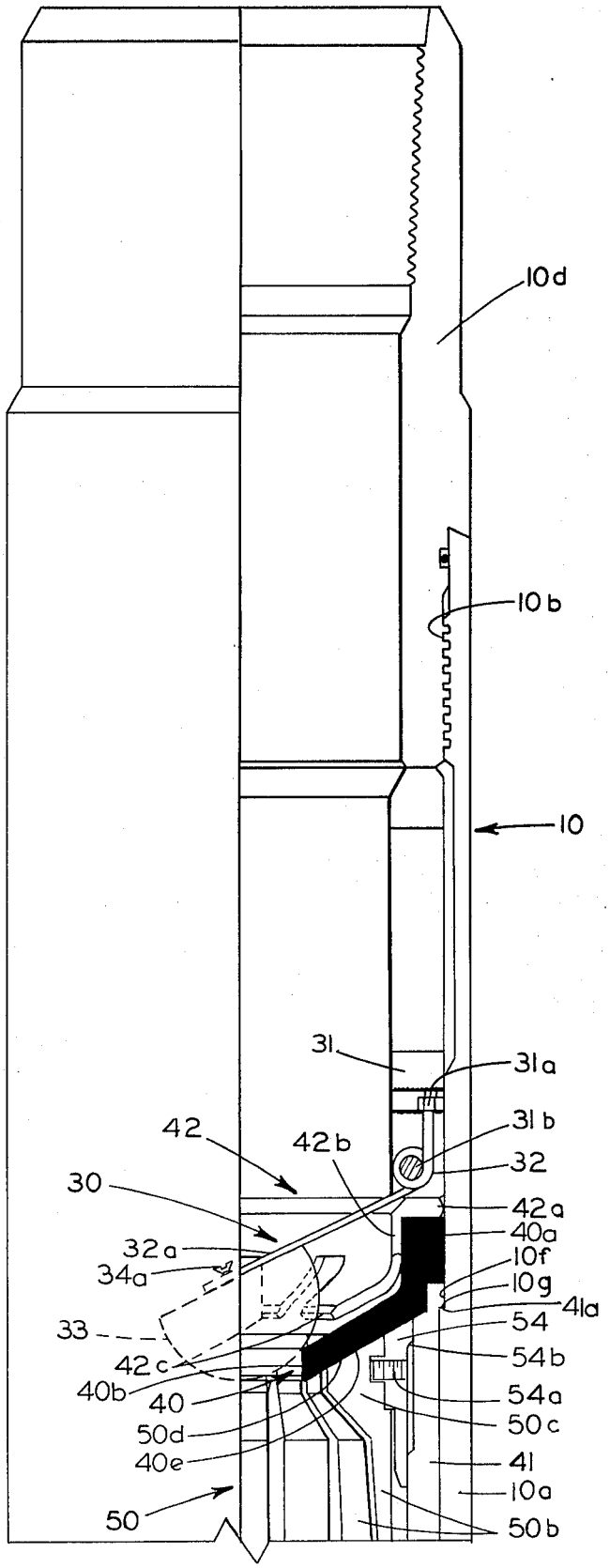
FIG. 3 is a further enlarged view of a portion of FIG. 2, and illustrates the elements of the formation protection valve in their closed position, following the removal of the gravel packing mandrel and wash pipe from the well.

Hence, whenever the wash pipe 20 is removed from the housing 10, the valve head 33 automatically swings downwardly and achieves a sealing engagement with the inner periphery of the annular elastomeric valve seat 40, as shown in FIG. 3. This action thus provides protection for the underlying formation from any fluids carried in the wash pipe 20 and the associated tubing string. Moreover, as the wash pipe 20 moves upwardly through the inner periphery 40*b* of the annular elastomeric valve seat 40 it is subjected to a wiping action to strip any remaining fluid from the surface of the wash pipe 20.

To ensure that the flapper valve assembly 30 will maintain its sealing engagement with the annular valve seat 40 even though the pressure above such valve seat may be significantly increased, a valve seat supporting mechanism is provided. Such mechanism includes a collet sleeve 50 having a solid ring portion 50*a* at its bottom and a plurality of axially extending collet arm portions 50*b* defining its upper portions. The ring portion 50*a* is secured by a plurality of radially disposed set screws 51*a* to a support ring 51 which is mounted in an appropriate recess 10*k* formed in the housing sleeve portion 10*a*. The upper ends of collet arm portions 50*b* are radially enlarged as indicated at 50*c* and are clamped in an inward position, against their inherent spring bias, by a ring element 54 which is engaged with some of the collet arm head portions 50*c* by shear screws 54*a*. In their internally compressed clamped positions, the top surfaces 50*d* of the enlarged head portions 50*c* define a conical surface supporting the correspondingly shaped bottom surface 40*e* of the annular elastomeric valve seat 40. Thus substantial fluid pressure may be applied to the bore of the housing 10 without disturbing the sealed relationship between the semi-spherical valve head 33 and the annular valve seat 40.

It is, however, necessary that the aforedescribed sealed relationship between the flapper valve assemblage 30 and the annular elastomeric valve seat 40 be opened to permit the bottom portions of a production string to be inserted through the housing 10 so that the bottom end of the production string may be positioned adjacent the production formation 1*a*. This may be accomplished solely by the forceable insertion of the bottom end 22*a* of a production string 22 in the manner illustrated in FIGS. 4 through 6.

Figure 4:
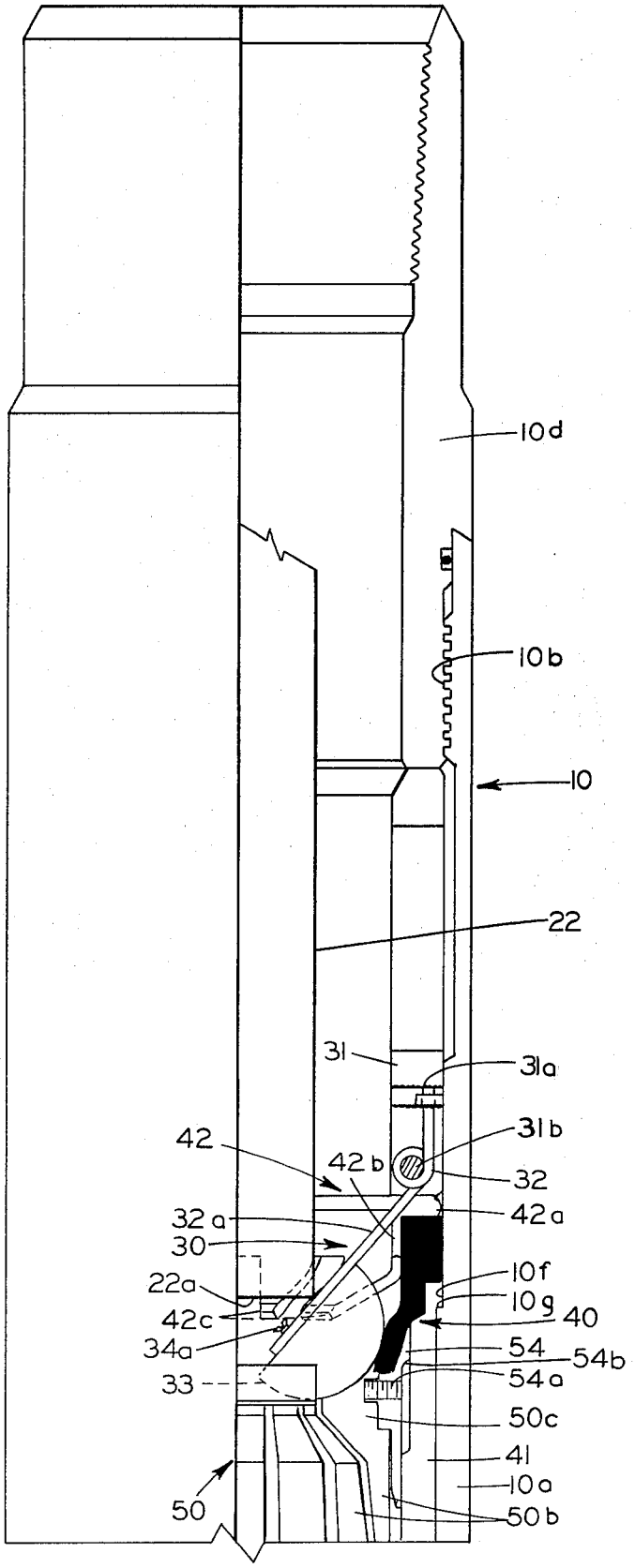
FIG. 4 is a view similar to FIG. 3 but shows the elements of the valve in the positions occupied after the subsequent forcible insertion of a production string partially through the annular elastomeric valve seat.

Referring first to FIG. 4, the bottom end 22*a* of a production string 22 is shown in engagement with the top surface of the spring arm 32*a* of the flapper valve assembly 30 and sufficient downward force has been applied by the production string 21 to cause the semi-spherical valve seat to depress the shearing fingers 42*c* of the seal shearing ring 42 downwardly. Such further downward movement produces a downward force on the collet support sleeve 50 and first effects a shearing of the shear screws 51*a* which hold such sleeve in its original vertical position in the housing 10. Continued downward movement of the production string 22 will effect a radial splitting of the inner peripheral portions of the annular elastomeric valve seat 40, by radially expanding the valve splitting fingers 42*c*.

Figure 5:
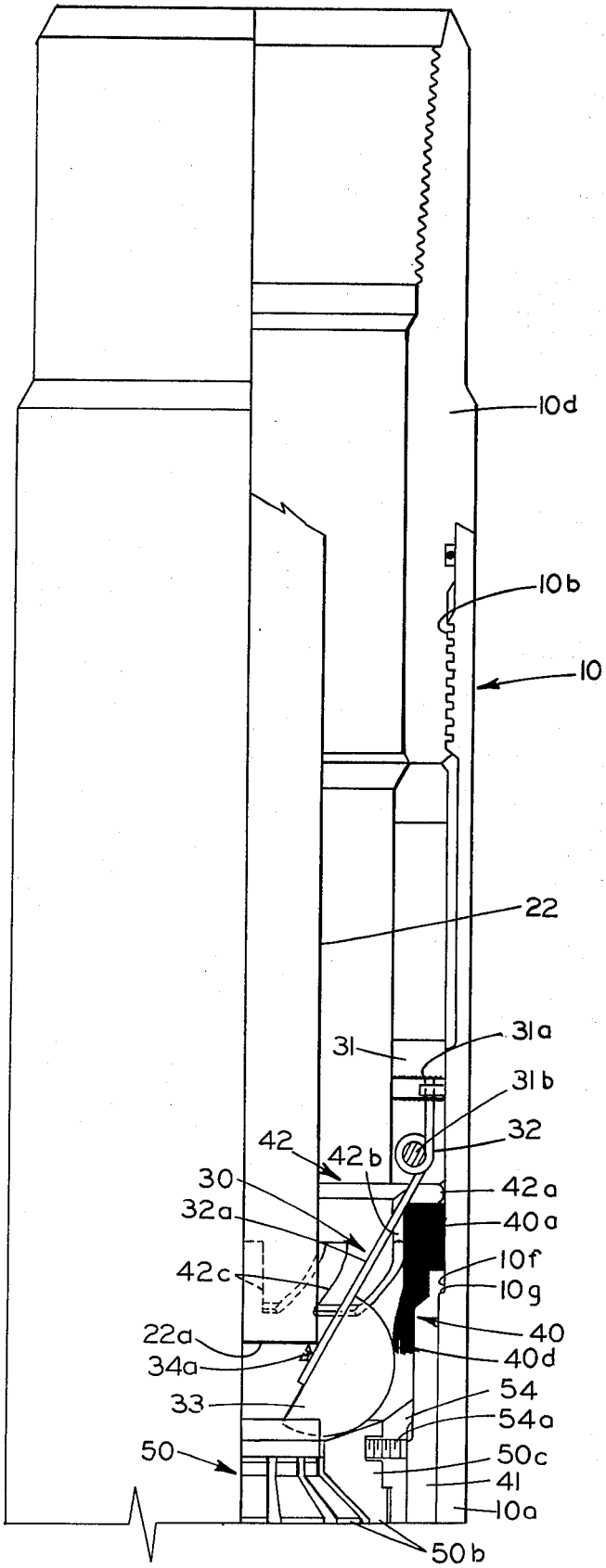
FIG. 5 is a view similar to FIG. 4, but illustrating the positions of the annular elastomeric valve seat and the seat shearing element after the further insertion of a production string through the valve seat, moving the seat support collet downwardly.

Referring next to FIG. 5, it will be observed that the semi-spherical valve head 33 has been moved downwardly an additional distance by the inserted end 22*a* of the production string 22 so as to bring the radially split portions 40*d* of the annular valve seat 40 into engagement with the side wall of the valve seat support ring 41. At this point, the end 22*a* of the downwardly moving production string 22 engages the upwardly projecting head portion 34*a* of the shear bolt 34 and effects the shearing of the bolt, thus freeing the semi-spherical valve head portion 33 from the spring arm 32 and permitting it to move downwardly with the further downward movement of the production string 22. It will be noted that the valve splitting fingers 42*c* cause a splitting of the annular elastomeric valve seat 40 only back to the enlarged peripheral portion 40*a*. It is thus assured that no pieces of the elastomeric material will be torn from the valve seat 40 by the splitting thereof, and this prevents interference of such pieces, which would be generally readily movable with any well fluid, with any other components of the well, either above or below the original location of the elastomeric valve seat 40.

Following such initial downward movement of the collet sleeve 50, a downwardly facing shoulder 54*b* provided on the perimeter of the collet compression sleeve 54 engages an upwardly facing shoulder 41*b* (FIG. 6) provided on the valve seat support sleeve 41 and prevents any further downward movement of the compression ring 54. This then causes the shear screws 54*a* between the compression ring 54 and the individual collet arm head portions 50*c* to be severed and the collet 50 moves freely downwardly with further downward movement of the inserted production string 22.

Figure 6:
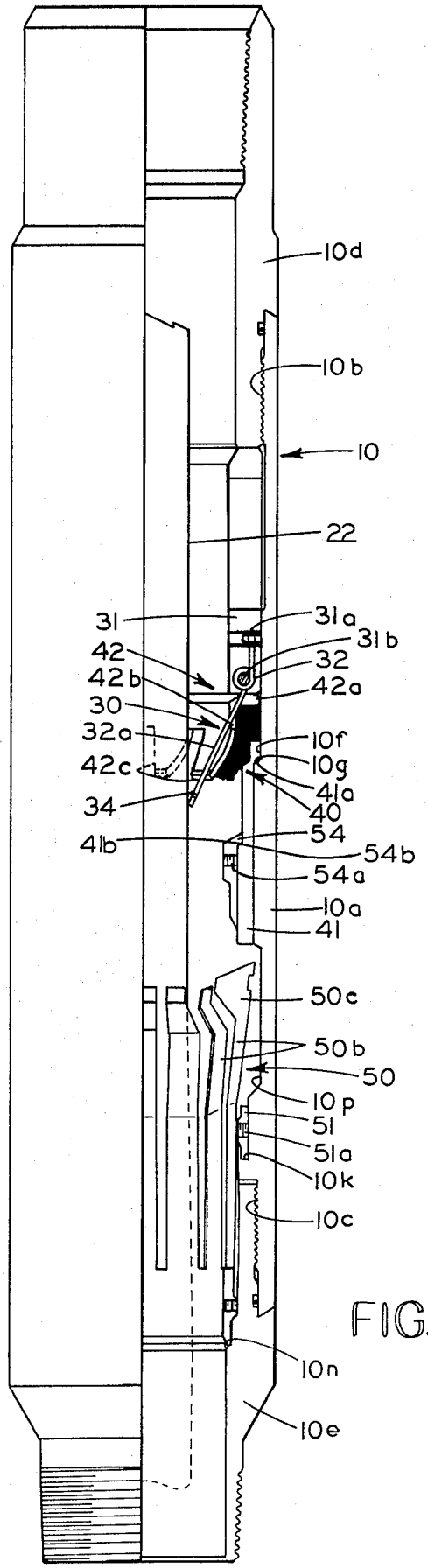
FIG. 6 is a view similar to FIG. 2 but illustrating the final position of the valve elements after the production string has moved through the valve housing.

The limit of downward movement of the collet sleeve 50 is determined by an upwardly facing shoulder 10*n* formed in the lower housing connector sub 10*e*. When the bottom surface of collet 50 reaches the shoulder 10*n*, however, the enlarged collet head portions 50*c* are aligned with an annular recess 10*p* provided in the internal bore of the housing sleeve portion 10*a* and such collet arms spring outwardly to position the enlarged head portions in the recess 10*p*, as illustrated in FIG. 6.

In this position, the inner ends of the enlarged collet head portions 50*c* are disposed outside of the path of the inserted production tubing 22 and are also large enough to permit the sheared hemispherical ball head 33 to pass freely therethrough and drop into the lower portions of the well. It will therefore be apparent that further downward movement of the production string 22 is completely unimpaired by the various elements of the formation protection valve 30 and the production string 22 may be subsequently removed and reinserted without incurring any interference with the elements of the protection valve 30.

In the event that it is desired to effect an opening of the protector valve assemblage 30, without passing the end of a production string through the valving elements, such can be accomplished by providing a sufficiently high pressure differential across the valve to cause the semi-spherical valve head 33 to be forced downwardly to cause the splitting of the annular valve seat member 40, and thus permit fluid flow around the valve head. Normally, however, the valve is opened by the insertion movement of the production string.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve for closing a well conduit comprising, in combination: a tubular housing threadedly insertable in the well conduit; an annular elastomeric valve seat having its outer periphery sealingly engaged with the bore of said housing; a valve head pivotally mounted in said housing for movement into sealing engagement with the inner periphery of said annular elastomeric valve seat; an annular metallic member mounted directly above said annular elastomeric valve, the inner peripheral portion of said annular metallic member comprising a plurality of circumferentially spaced radial fingers overlying the radially medial portion of said annular elastomeric valve seat, said radial fingers being pushed downwardly and outwardly by the insertion movement of a tubing string through said housing to assume a substantially vertical position and radially shear the inner periphery of said annular elastomer valve seat to permit said valve head and the tubing string to pass downwardly therethrough.

2. The apparatus of claim 1 wherein the outer peripheral portion of said annular metallic member snugly surrounds the outer peripheral portion of said annular elastomeric seal element to prevent the complete splitting of said elastomeric seal element.

3. The apparatus of claim 2, further comprising an annular valve seat support mounted in said valve housing below said annular elastomeric valve seat and having an upwardly facing surface engaging the bottom surface of said annular elastomeric valve seat to support same against fluid pressure forces exerted on said valve head in its closed position; and shearable means preventing downward movement of said valve seat support, said shearable means being shearable by downward forces exerted by a subsequently inserted tubing string on said valve head and said elastomeric valve seat.

4. A flapper valve for closing a well conduit comprising, in combination: a tubular housing threadably insertable in the well conduit; an annular elastomeric valve seat having its outer periphery sealingly engaged with the bore of said housing; a valve head pivotally mounted in said housing for downward movement into sealing engagement with the inner periphery of said annular elastomeric valve seat; an annular valve seat support mounted in said valve housing below said annular elastomeric valve seat and having an upwardly facing surface engaging the bottom surface of said annular elastomeric valve seat to support same against fluid pressure forces exerted on said valve head in its closed position; and shearable means preventing downward movement of said valve seat support, said shearable means being shearable by forces exerted by a subsequently inserted tubing string on said valve head and said elastomeric valve seat.

5. The apparatus of claim 3 or 4 wherein said annular valve seat support comprises a collet sleeve having a lower sleeve portion slidable in said valve housing and an integral upper portion comprising a plurality of peripherally spaced resilient collet arms, second shearable means for holding the top surfaces of said collet arms in a radially inward position supportively engaging the bottom surface of said annular elastomeric valve seat, and an annular recess in said valve housing disposed below the valve seat supporting position of said collet sleeve, said collet arms being inherently expandable into said annular recess when forcibly moved downward by a tubing string into alignment therewith, thereby permitting unimpeded passage of a tubing string through said valve housing.

6. In a subterranean well having a perforated casing adjacent a production zone, a packer engaging said casing above the production zone and supporting a depending tubular housing assembly including a screen disposed within the perforated zone of the casing, and a gravel packing wash pipe and crossover tube removably inserted within said depending tubular housing for effecting the gravel packing of the production formation and screen, the improvement comprising: a tubular valve housing threadably connectable in said depending housing assembly in series relationship at a position above said screen; an annular elastomeric valve seat; means for mounting said elastomeric valve seat transversely within said valve housing and in sealing relationship with said valve housing; a valve head engagable with said annular elastomeric valve seat in sealing relationship; means including a support arm for shiftably mounting said valve head in said housing for movement between a lower closed position engaging said annular elastomeric valve seat and an upper open position radially displaced to abut the exterior surface of the inserted wash pipe; resilient means urging said valve head to said closed position to cause shifting of said valve head to said closed position upon withdrawal of the wash pipe, and a shearable connection between said valve head and said support arm, said valve head severable by subsequent insertion of a production conduit through said elastomeric valve seat to move said valve head through said elastomeric valve seat to an inoperative position in the well.

7. The apparatus of claim 6 wherein said valve head comprises a hemispherical body secured by a shearable member to the end of a spring arm, the other end of said arm being horizontally pivoted to said valve housing, said shearable member being sheared by the end of an inserted production string.

8. The apparatus of claim 6 wherein an annular metallic member is mounted directly above said annular elastomeric valve, the inner peripheral portion of said annular metallic member comprising a plurality of peripherally spaced radial fingers overlying the radially medial portion of said annular elastomeric valve seat, said radial fingers being pushed downwardly and outwardly by the insertion movement of a production string to assume a substantially vertical position and radially shear the inner periphery of said annular elastomer valve seat to permit said valve head and the production string to pass downwardly therethrough.

9. The apparatus of claim 8 wherein the outer peripheral portion of said annular metallic member snugly surrounds the outer peripheral portions of said annular elastomeric seal element to prevent the complete splitting of said elastomeric seal element.

10. The apparatus of claim 6, further comprising an annular valve seat support mounted in said valve housing below said annular elastomeric valve seat and having an upwardly facing surface engaging the bottom surface of said annular elastomeric valve seat to support same against fluid pressure forces exerted on said valve head in its closed position, and shearable means preventing downward movement of said valve seat support, said shearable means being shearable by downward forces exerted by a subsequently inserted production string on said valve head and said elastomeric valve seat.

11. The apparatus of claim 10 wherein said annular valve seat support comprises a collet sleeve having a lower sleeve portion slidable in said valve housing and an integral upper portion comprising a plurality of peripherally spaced resilient collet arms, second shearable means for holding the top surfaces of said collet arms in a radially inward position supportively engaging the bottom surface of said annular elastomeric valve seat, and an annular recess in said valve housing disposed below the valve seat supporting position of said collet sleeve, said collet arms being inherently expandable into said annular recess when moved forcibly downward by a production string into alignment therewith, thereby permitting unimpeded passage of a production string through said valve housing.

12. In a subterranean well having a perforated casing adjacent a production zone, a packer engaging said casing above the production zone supporting a depending tubular housing assembly including a screen disposed within the perforated zone of the casing, and a removable gravel packing wash pipe and crossover tube mounted within said tubular housing for effecting the gravel packing of the production formation and screen, the improvement comprising: a tubular valve housing threadably connectable in said depending housing assembly at a position above said screen, an annular elastomeric valve seat mounted in said housing, a valve head shearably connected to a support arm pivotally movable in a vertical plane between an open position above said annular valve seat to a closed position engaging the top surface of said annular valve seat, said valve head being engagable by the inserted wash pipe to hold it in said open position, whereby withdrawal of the inserted wash pipe permits said valve head to pivot downwardly into sealing engagement with said annular valve seat, resilient means urging said valve head to said closed position, said valve head being severable from said support arm by a subsequently inserted production tubing and forced through said annular elastomeric valve seat to an inoperative position in the well.

13. The apparatus of claim 6 or 12 wherein the inner periphery of said annular elastomeric valve seat frictionally engages the periphery of the wash pipe, thereby wiping fluid from said wash pipe as it is withdrawn from the well.

* * * * *